US006449375B1

(12) United States Patent
Hutt

(10) Patent No.: US 6,449,375 B1
(45) Date of Patent: Sep. 10, 2002

(54) LOUDSPEAKER SPIDER WITH REGRESSIVE ROLLS

(75) Inventor: Steven W. Hutt, Bloomington, IN (US)

(73) Assignee: Harmon International Industries, Incorporated, Northridge, CA (US)

( * ) Notice: Subject to any disclaimer, the term of this patent is extended or adjusted under 35 U.S.C. 154(b) by 0 days.

(21) Appl. No.: 09/401,598

(22) Filed: Sep. 22, 1999

(51) Int. Cl.[7] ..... H04R 25/00
(52) U.S. Cl. ..... 381/403; 381/403; 181/172
(58) Field of Search ..... 381/403, 404, 381/405, 398, FOR 157, 152, 162, 182, 184, 185, 191, 407, 423, 424, 432; 181/166, 171, 172

(56) References Cited

U.S. PATENT DOCUMENTS

| | | | | | |
|---|---|---|---|---|---|
| 2,201,059 | A | | 5/1940 | Stephan | |
| 2,295,483 | A | | 9/1942 | Knowles | |
| 2,358,823 | A | * | 9/1944 | O'Connor et al. | 181/172 |
| 2,922,850 | A | * | 1/1960 | Zuerker | 381/404 |
| 2,997,549 | A | * | 8/1961 | Hassan | 381/404 |
| 3,125,647 | A | * | 3/1964 | Rouy | 381/404 |
| 4,531,025 | A | * | 7/1985 | Danley et al. | 381/404 |
| 5,014,323 | A | * | 5/1991 | Markow et al. | 381/404 |
| 5,715,324 | A | | 2/1998 | Tanabe et al. | |
| 6,351,544 | B1 | * | 2/2002 | Noll | 381/398 |

* cited by examiner

*Primary Examiner*—Curtis Kuntz
*Assistant Examiner*—Suhan Ni

(57) ABSTRACT

A transducer includes a supporting frame, a motor assembly providing a magnetic field across an air gap, a coil former supporting a voice coil in the magnetic field, a diaphragm attached to the coil former and coupled by a surround at its outer perimeter to the frame, and a spider having an inner perimeter coupled to the coil former and an outer perimeter coupled to at least one of the frame and motor assembly. The spider includes a plurality of rolls. The roll next adjacent the inner perimeter may have a first height. The roll next adjacent the outer perimeter may have a second height less than the first height. The surround may include a plurality of rolls. The roll next adjacent the diaphragm may have a third height, and the roll next adjacent the frame a fourth height less than the third height.

15 Claims, 2 Drawing Sheets

LOUDSPEAKER SPIDER WITH REGRESSIVE ROLLS

FIELD OF THE INVENTION

This invention relates to electrodynamic transducers, and primarily to the construction of moving coil loudspeakers. However, it is believed useful in other applications as well.

BACKGROUND OF THE INVENTION

Various configurations of centering spiders for loudspeakers are known. There are, for example, the centering spiders illustrated and described in U. S. Pat.: Nos.2,201,059; 2,295,483; and, 5,715,324. This listing is not intended as a representation that a thorough search of the prior art has been conducted or that no more pertinent art than that listed above exists, and no such representation should be inferred.

Loudspeaker suspensions include a diaphragm surround and a voice coil centering spider. The function of the spider is to keep the voice coil centered in the loudspeaker's permanent magnet motor air gap, while at the same time permitting linear motion of the voice coil in the air gap, and thus driving the diaphragm, to which the voice coil is mounted by the coil former, in as linear a fashion as possible. Ordinarily spiders are constructed from thermosetting resin-impregnated woven materials, such as natural and synthetic fibers. The resin-impregnated material is then heated in a mold to form corrugations, or rolls, usually concentric with the axis of the voice coil former, and usually of equal height and equal radius. The spider is then attached at its inner perimeter to the coil former and at its outer perimeter to the loudspeaker magnet motor assembly or loudspeaker frame, usually where the frame and motor assembly are joined to each other. The inner perimeter of the spider thus undergoes the same excursion as the coil former, and the outer perimeter of the spider is stationary, being mounted to the frame and/or motor assembly.

Conventional spiders exhibit asymmetric stiffness with respect to force versus deflection. When calculating the volume of material in the rolls of a conventional spider, it is clear that there is more material in the outer rolls, that is, in the rolls at increased distances from the axis of the coil former. Due to this increased amount of material in the rolls at greater distances from the axis of the coil former, the stiffness of the rolls varies regressively outwardly. That is, stiffness decreases with increasing distance from the axis of the voice coil and coil former.

DISCLOSURE OF THE INVENTION

According to the invention, a transducer includes a supporting frame, a motor assembly providing a magnetic field across an air gap, a coil former supporting a voice coil in the magnetic field, a diaphragm attached to the coil former and coupled by a surround at its outer perimeter to the frame, and a spider having an inner perimeter coupled to the coil former and an outer perimeter coupled to at least one of the frame and motor assembly. The spider includes a plurality of rolls. The roll next adjacent the inner perimeter has a first height. The roll next adjacent the outer perimeter has a second height less than the first height.

Illustratively according to the invention, the transducer further includes at least one intermediate roll having a third height less than the first height and greater than the second height.

Further illustratively according to the invention, the height of the rolls decreases linearly from the roll next adjacent the inner perimeter to the roll next adjacent the outer perimeter.

BRIEF DESCRIPTION OF THE DRAWINGS

The invention may best be understood by referring to the following detailed description and the accompanying drawings which illustrate the invention. In the drawings.

DETAILED DESCRIPTION OF ILlUSTRATIVE EMBODIMENTS

The spider of the present invention has regressively varying corrugation, or roll, pitch, or height, with maximum roll height adjacent the coil former and decreasing roll height at some greater distance from the axis of the coil former.

Figure 1:
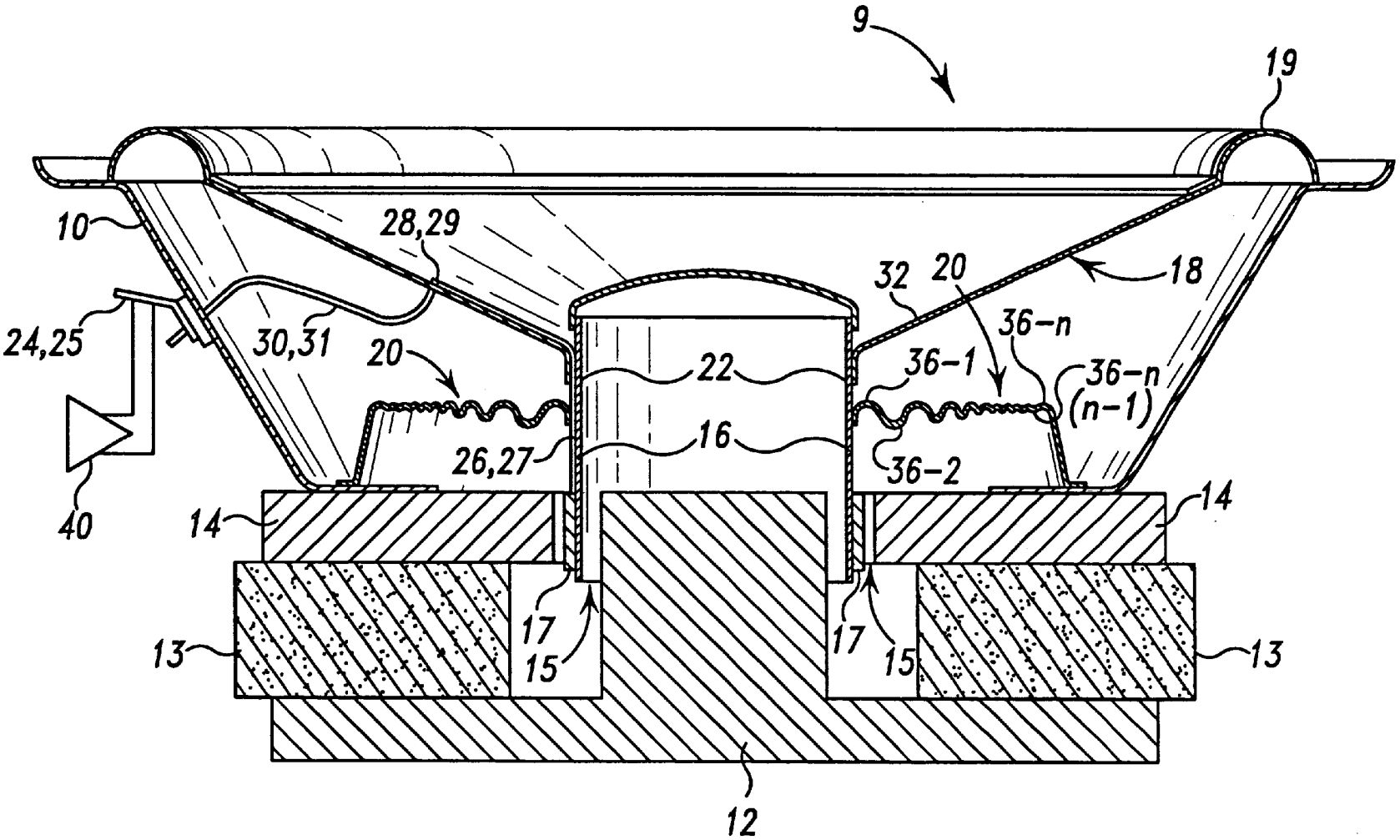
FIG. 1 illustrates a fragmentary cross-section through a loudspeaker constructed according to the invention; and, FIG. 2 illustrates an enlarged detail of a fragmentary cross-section through another loudspeaker constructed according to the invention.

Referring now to FIG. 1, a loudspeaker 9 includes a supporting frame 10 and a motor assembly. The illustrated motor assembly includes a backplate/center pole 12, a permanent magnet 13, and a front plate 14 providing a substantially uniform magnetic field across an air gap 15. A voice coil former 16 supports a voice coil 17 in the magnetic field. Current from an amplifier 40 related to the program material to be transduced by the loudspeaker 9 drives the voice coil 17, causing it to reciprocate axially in the air gap 15 in a known manner. A cone 18 attached at its apex to an end of the coil former 16 lying outside the motor assembly 12, 13, 14 is coupled by a surround 19 at its outer perimeter to the frame 10. A spider 20 is coupled at its outer perimeter to the frame 10. The spider 20 includes a central opening 22 to which the voice coil former 16 is attached. The suspension including the surround 19 and spider 20 constrains the voice coil 17 to reciprocate axially in the air gap 15.

A typical, although by no means the only, mechanism for completing the electrical connection between the loudspeaker terminals 24, 25 and the voice coil wires 26, 27 is illustrated in the Figure. The voice coil wires 26, 27 are dressed against the side of the coil former 16, and pass through central opening 22 and the intersection of the coil former 16 and the apex of the cone 18. Wires 26, 27 are then dressed across the face 32 of the cone 18 to the points 28, 29 on the face of the cone 18 where they are connected to the flexible conductors 30, 31. Connections 28, 29 are made by any of a number of available techniques. The coil wires 26, 27 illustratively are fixed to the face 32 of the cone 18 with (an) electrically non-conductive adhesive(s).

The spider 20 has regressively varying corrugation or roll 36, pitch, or height, with maximum roll 36 height (roll 36-1) adjacent the coil former 16 and decreasing roll 36 height (roll 36-n) at some greater distance from the axis of the coil former 16. This decreased roll 36 height compensates for the above-noted inconsistent stfthess inner rolls 36-1 36-2 . . . have more material, that is, by making the inner rolls 36-1, 36-2, . . . have greater height and/or pitch than the outer rolls . . . 36-(n-1), 36-n. This effectively reduces the stiffness of the inner rolls 36-1, 36-2, . . . , thereby matching their stiffness to the stiffness of the outer rolls . . . 36-(n1), 1), 36-n and equalizing stress across the radius of the spider 20. This enhances the linearity of the voice coil 17 motion and reduces distortion caused by non-linear motion of the voice coil 17 and coil former 16.

The height of the rolls 36 can be decreases linearly, exponentially, stepwise, or in any other way which substantially achieves the effect of renderng approximately equal the stiffness of the rolls 36 across the radius of the spider 20 from the roll 36-1 next adjacent the coil former 16 to the roll 36-n next adjacent the frame 10 and/or motor assembly 12, 13, 14, and equalizing stress across the radius of the spider 20 from the roll 36-1 next adjacent the coil former 16 to the roll 36-n next adjacent the frame 10 and/or motor assembly 12, 13, 14. The spider 20 thus employs rolls 36 of regressively diminishing height from the spider 20 inside diameter to the spider 20 outside diameter. The rolls 36 may have diminishing radii from the spider 20 inside diameter to the spider 20 outside diameter.

Figure 2:
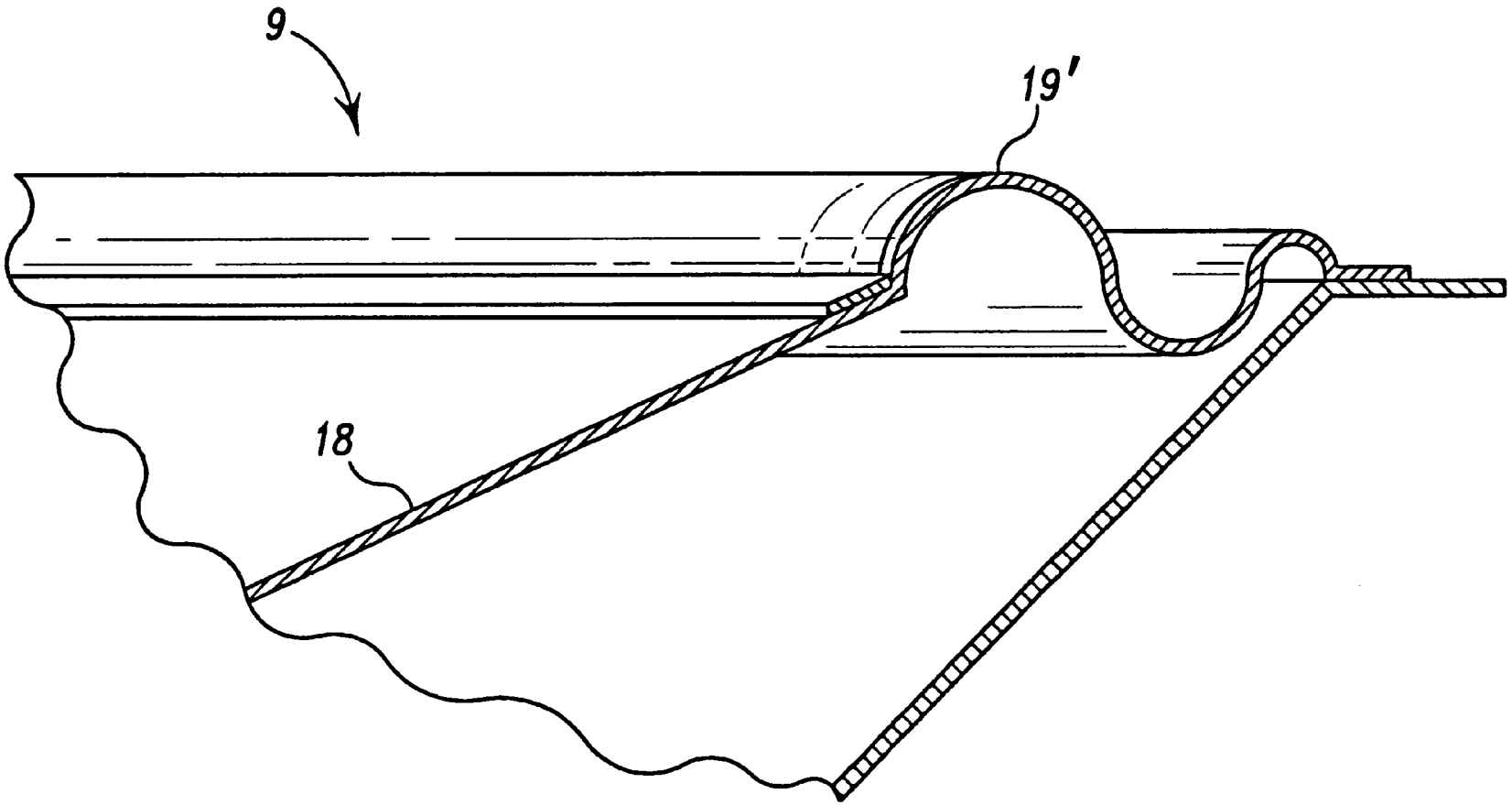

The roll 36 sidewalls may have diminishing length from the spider 20 inside diameter to the spider 20 outside diameter. The regressively diminishingolls 36 balance stresses more uniformly over the width of the spider 20. The regressively diminishing rolls 36 may be used with a flat outer foot configuration where the spider 20 is coupled at its outer perimeter to the frame 10 and/or motor assembly 12, 13, 14, or with the illustrated cupped outer foot configuration where the spider 20 is coupled at its outer perimeter to the frame 10 and/or motor assembly 12, 13, 14. The regressively diminishing rolls 36 may be used with a "neck-up" attachment of the central opening 22 of spider 20 to the coil former 16 or with the illustrated "neckdown" attachment of the central opening 22 of spider 20 to the coil former 16. The spider 20's compliance is more linear over the full range of deflection of the spider 20 as the voice coil 17 moves in the air gap 15. Non-linear distortion is thereby decreased. The inventive regressive roll 36 geoetry may also be emloyed on multi-roll loudspeaker cone 18 surrounds 19' as illustrated in FIG. 2.

What is claimed is:

1. A transducer including a supporting a frame, a motor assembly providing a magnetic field across an air gap, a coil former supporting a voice coil in the magnetic field, a diaphragm attached to the coil former and coupled by a surround at its outer perimeter to the frame, and a spider having an inner perimeter coupled to the coil former and an outer perimeter coupled to at least one of the frame and motor assembly, the spider including at least three rolls, the roll next adjacent the inner perimeter having a first height, the roll next adjacent the outer perimeter having a second height less than the first height, and the third roll lying between the first and second rolls and having a third height less than the first height and greater than the second height.

2. The transducer of claim 1 wherein the height of the rolls decreases linearly from the roll next adjacent the inner perimeter to the roll next adjacent the outer perimeter.

3. A transducer that includes a speaker frame, a cone coupled with the speaker frame and a coil former coupled with the cone, the transducer further comprising:

a spider coupled with coil former and the speaker frame, the spider concentrically extending from the coil former to the speaker frame; and at least three rolls formed in the spider concentric with the coil former, each of the at least three rolls having a radius, wherein the radii of the at least three rolls are progressively smaller from the coil former toward the speaker frame.

4. The transducer of claim 3, wherein the at least three rolls each comprise sidewalls of a predetermined length, wherein the length of the sidewalls of the at least three rolls are progressively shorter from the coil former toward the speaker frame.

5. The transducer of claim 3, wherein the spider further comprises a flat outer foot configuration formed to couple with the speaker frame.

6. The transducer of claim 3, wherein the spider further comprises a cupped outer foot configation formed to couple with the speaker frame.

7. The transducer of claim 3, wherein the spider is coupled with the coil former in a neck up attachment.

8. The transducer of claim 3, wherein the spider is coupled with the coil former in a neck down attachment.

9. A transducer that includes a speaker frame, a cone coupled with the speaker frame and a coil former coupled with the cone, the transducer further comprising:

a spider having an inside diameter and an outside diameter, the inside diameter coupled with the coil former and the outside diameter coupled with speaker frame;

the spider comprising at least three corrugations formed between the inside diameter and the outside diameter to surround the coil former, each of the at last three corrugations having a sidewall of a predetermined length, wherein the sidewall of the at least three corrugations are progressively shorter in length from the spider inside diameter toward the spider outside diameter.

10. The transducer of claim 9, wherein each of the at least three corrugations is formed with a predetermined radius, wherein the radii of the at least three corrugations are progressively smaller from the coil former toward the speaker frame.

11. The transducer of claim 9, wherein the length of the sidewalls in each of the at least three corrugations decrease linearly.

12. The transducer of claim 9, wherein the length of the sidewalls in each of the at least three corrugations decrease stepwise.

13. The transducer of claim 9, wherein the length of the sidewalls in each of the at least three corruptions decrease exponentially.

14. The transducer of claim 9, wherein the length of the sidewalls in each of the at least three corrugations decrease randomly.

15. The transducer of claim 9, wherein the least three corrugations are operable to balance stresses uniformly over the width of the spider.

* * * * *

UNITED STATES PATENT AND TRADEMARK OFFICE

CERTIFICATE OF CORRECTION

PATENT NO. : 6,449,375 B1
DATED : September 10, 2002
INVENTOR(S) : Hutt

It is certified that error appears in the above-identified patent and that said Letters Patent is hereby corrected as shown below:

Title page,
Item [73], Assignee, please replace the name "Harmon" with -- Harman --.

Signed and Sealed this

Twenty-fifth Day of February, 2003

JAMES E. ROGAN
*Director of the United States Patent and Trademark Office*